United States Patent [19]

Haka et al.

[11] 4,186,703

[45] Feb. 5, 1980

[54] EXHAUST GAS RECIRCULATION CONTROL

[75] Inventors: Raymond J. Haka, Rochester, Mich.; Donald D. Stoltman, Henrietta, N.Y.

[73] Assignee: General Motors Corporation, Detroit, Mich.

[21] Appl. No.: 940,079

[22] Filed: Sep. 6, 1978

[51] Int. Cl.[2] ..... F02M 25/06

[52] U.S. Cl. ..... 123/119 A

[58] Field of Search ..... 123/119 A

[56] References Cited

U.S. PATENT DOCUMENTS

| | | | |
|---|---|---|---|
| 3,756,210 | 4/1973 | Kuehl | 123/119 A |
| 3,762,384 | 10/1973 | Bay et al. | 123/119 A |
| 3,783,848 | 1/1974 | Ranet et al. | 123/119 A |
| 3,791,360 | 2/1974 | Rieger | 123/119 A |
| 3,799,131 | 3/1974 | Bolton | 123/119 A |
| 3,800,765 | 4/1974 | Thompson | 123/119 A |
| 3,802.402 | 4/1974 | Swatman | 123/119 A |
| 3,834,363 | 9/1974 | Goto et al. | 123/119 A |
| 3,834,366 | 9/1974 | Kingsbury | 123/119 A |
| 3,844,261 | 10/1974 | Garcea | 123/119 A |
| 3,880,129 | 4/1975 | Hollis, Jr. | 123/119 A |
| 3,881,456 | 5/1975 | Nohira et al. | 123/119 A |
| 3,896,777 | 7/1975 | Masaki et al. | 123/119 A |
| 3,928,966 | 12/1975 | Goto et al. | 123/119 A X |
| 3,931,813 | 1/1976 | Horie et al. | 123/119 A |
| 3,974,807 | 8/1976 | Nohira et al. | 123/119 A |
| 3,982,155 | 9/1976 | Bradshaw | 123/119 A |
| 4,027,638 | 6/1977 | Moriya et al. | 123/119 A |
| 4,031,871 | 6/1977 | Hamanishi | 123/119 A |
| 4,041,917 | 8/1977 | Suzuki | 123/119 A |
| 4,044,735 | 8/1977 | Sumiyoshi | 123/119 A |
| 4,069,797 | 1/1978 | Nohira et al. | 123/119 A |
| 4,069,798 | 1/1978 | Thornburch | 123/119 A |
| 4,079,710 | 3/1978 | Moriya et al. | 123/119 A |
| 4,090,482 | 5/1978 | Yoshida | 123/119 A |
| 4,092,960 | 6/1978 | Nohira et al. | 123/119 A |
| 4,094,287 | 6/1978 | Nohira | 123/119 A |
| 4,098,246 | 7/1978 | Noguchi et al. | 123/119 A |
| 4,100,734 | 7/1978 | Ozaki et al. | 123/119 A |
| 4,112,894 | 9/1978 | Nohira | 123/119 A |
| 4,114,577 | 9/1978 | Aoyama | 123/119 A |

FOREIGN PATENT DOCUMENTS

| | | | |
|---|---|---|---|
| 1380046 | 1/1971 | United Kingdom | 123/119 A |

OTHER PUBLICATIONS

Research Disclosure 15212, Dec. 1976.

*Primary Examiner*—Wendell E. Burns
*Attorney, Agent, or Firm*—C. K. Veenstra

[57] ABSTRACT

A switching member simultaneously establishes a reference pressure and selects the pressure in one of two zones of a recirculation passage to create a control pressure, and a transducer regulates an operating pressure which positions a control valve to provide exhaust gas recirculation at rates which establish the pressures in the zones necessary to maintain the control pressure equal to the reference pressure. Exhaust gas recirculation thus varies with engine exhaust backpressure and accordingly is a proportion of induction air flow with the proportion being ruled by the switching member.

5 Claims, 1 Drawing Figure

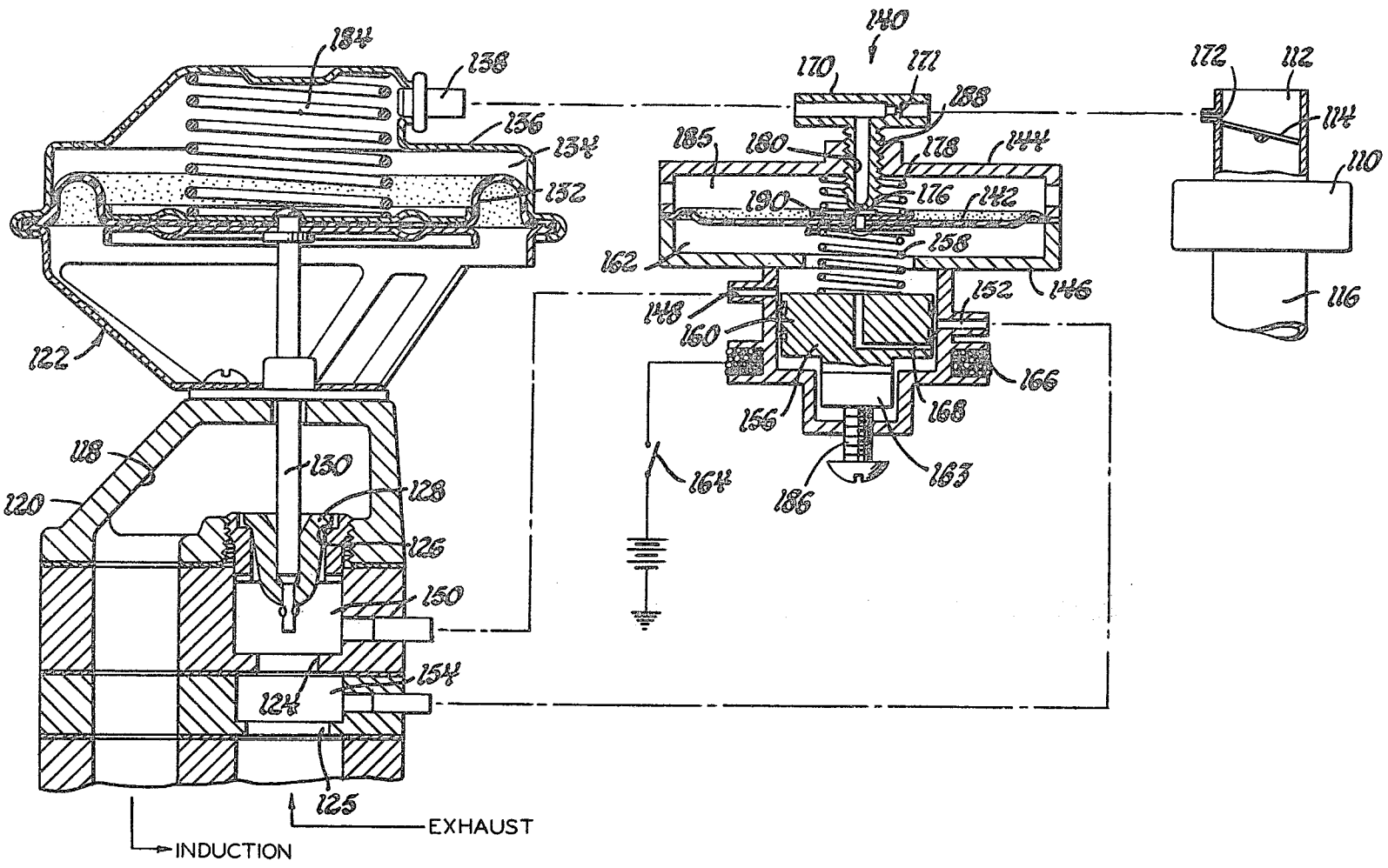
EXHAUST
INDUCTION

EXHAUST GAS RECIRCULATION CONTROL

TECHNICAL FIELD

This invention relates to control of exhaust gas recirculation and provides a novel assembly for controlling exhaust gas recirculation in proportion to induction air flow and for changing the proportion for selected operating conditions.

BACKGROUND

Recirculation of exhaust gases has been developed as a method for inhibiting formation of oxides of nitrogen during the combustion process in an internal combustion engine. In general, it is desired to recirculate exhaust gases at a rate proportional to the rate of induction air flow. To accomplish that purpose, exhaust gas recirculation (EGR) control assemblies have included an EGR control valve pintle positioned to provide exhaust gas recirculation at rates which maintain the pressure in the EGR passage upstream of the pintle equal to a reference pressure. Recirculation of exhaust gases has thus been varied with exhaust backpressure, which in turn varies as a function of induction air flow, to provide exhaust gas recirculation substantially proportional to induction air flow.

Such prior EGR control assemblies generally included a transducer for regulating a subsatmospheric operating pressure by which the control valve pintle was positioned. The transducer employed an air bleed valve to regulate the operating pressure—opening an air bleed to increase the operating pressure which caused the control valve pintle to reduce exhaust gas recirculation when the induction air flow (and thus the engine exhaust backpressure) decreased and the control pressure accordingly started to fall below the reference pressure, and closing the air bleed which reduced the operating pressure and caused the control valve pintle to increase exhaust gas recirculation when the induction air flow (and thus the engine exhaust backpressure) increased and the control pressure accordingly started to rise above the reference pressure. The bleed valve was carried on a control diaphragm subjected on one side to the control pressure in the EGR passage and balanced by atmospheric pressure on the opposite side and by the bias of a spring; the combination of atmospheric pressure and the spring bias formed the reference pressure.

Various controls have been adopted to cancel the operating pressure used by such assemblies and thus entirely preclude exhaust gas recirculation under conditions such as idle, wide open throttle and low temperature operation. For other selected conditions such as heavy load operation, however, it may be desired to provide exhaust gas recirculation in relatively high proportion to induction air flow, while for conditions such as light load operation it may be desired to provide exhaust gas recirculation in relatively low proportion to induction air flow.

One proposal for changing the proportion of exhaust gases recirculated involved varying the reference pressure with engine operating conditions—increasing the reference pressure to effect an increase in the control pressure and thus reduce exhaust gas recirculation when a lower proportion is desired, and decreasing the reference pressure to effect a decrease in the control pressure and thus increase exhaust gas recirculation when a higher proportion is desired. That proposal is set forth in copending application Ser. No. 879,781 filed Feb. 21, 1978 in the name R. J. Haka.

Another proposal for changing the proportion of exhaust gases recirculated involved maintaining the pressure in a restricted pressure zone of the recirculation passage equal to the reference pressure when a low proportion is desired and maintaining the pressure in an unrestricted pressure zone of the recirculation passage equal to the reference pressure when a high proportion is desired—the proportion then being determined by the size of the pressure zone. That proposal is set forth in copending application Ser. No. 929,653 filed July 31, 1978 in the name of D. D. Stoltman.

THE INVENTION

This invention provides an exhaust gas recirculation control assembly combining certain features of those proposals into a single unit which simultaneously establishes a high reference pressure and maintains the pressure in a restricted zone of the recirculation passage equal to that high reference pressure when a low proportion of exhaust gas recirculation is desired, and which simultaneously establishes a low reference pressure and maintains the pressure in an unrestricted zone of the recirculation passage equal to that low reference pressure when a high proportion of exhaust gas recirculation is desired.

The details as well as other features and advantages of this invention are set forth in the remainder of the specification and are shown in the drawing.

THE DRAWING

The sole FIGURE of the drawing is a schematic view of an exhaust gas recircualtion control system employing this invention.

BEST MODE FOR CARRYING OUT THE INVENTION

Referring to the drawing, an internal combustion engine 110 has an air induction passage 112, a throttle 114 controlling induction air flow through passage 112, and an exhaust passage 116. An EGR passage 118 extends from exhaust passage 116 through the body 120 of an EGR control unit 122 and then to induction passage 112 downstream of throttle 114.

A pair of orifices 124 and 125 are disposed in EGR passage 118 upstream of a valve seat 126. A control valve pintle 128 is associated with a valve seat 126 and has a stem 130 extending to an operating diaphragm 132. Operating diaphragm 132 forms a portion of an operating pressure chamber 134 closed by a cover 136. Cover 136 has a fitting 138 receiving the operating pressure created by transducer 140.

Transducer 140 has a control diaphragm 142 clamped between a cover 144 and a transducer housing 146. A port 148 on housing 146 is connected to sense the pressure in the zone 150 of EGR passage 118 downstream of orifice 124, and a port 152 on housing 146 is connected to sense the pressure in the zone 154 of EGR passage 118 between orifices 124 and 125. A switching member 156 is biased by a spring 158 so that a regulating valving land 160 obstructs port 152 and opens port 148 to the control pressure chamber 162 formed by control diaphragm 142 and housing 146. Switching member 156 has a magnetically responsive portion 163 defining a solenoid armature, and upon closure of a switch 164, a coil 166 is energized to lift switching member 156 against the bias of spring 158 to a position where regulating valving land 160 obstructs port 148 and opens a passage 168 between fitting 152 and control pressure chamber 162.

Transducer 140 has a T-fitting 170 with an aperture 171 which senses the pressure signal created at a port 172 in induction passage 112 adjacent the edge of throttle 114 and supplies an operating pressure to fitting 138. Aperture 171 senses the subatmospheric induction passage pressure downstream of throttle 114 during open throttle operation and the substantially atmospheric pressure upstream of throttle 114 during idle and other closed throttle modes of operation.

During operation when coil 166 is not energized, any increase in pressure in zone 150 is sensed by control pressure chamber 162, and control diaphragm 142 lifts a bleed valve 176 against the bias of a spring 178 to obstruct air flow through an air bleed 180. The operating pressure in chamber 134 is then reduced by the subatmospheric pressure signal sensed through aperture 171, and operating diaphragm 132 is raised against the bias of a spring 184 to lift control valve pintle 128 from valve seat 126. The resulting increase in the exhaust gas recirculation area between control valve pintle 128 and valve seat 126 provides increased exhaust gas recirculation, and the pressure in zone 150 decreases to balance the control pressure in chamber 162 with the reference pressure created by the bias of springs 158 and 178 and atmospheric pressure in chamber 185.

Upon a decrease in pressure in zone 150, control diaphragm 142 lowers bleed valve 176 away from bleed 180 to permit air flow through bleed 180 into chamber 134. The increased operating pressure in chamber 134 then allows spring 184 to lower operating diaphragm 132 and control valve pintle 128 toward valve seat 126. The resulting decrease in the exhaust gas recirculation area reduces exhaust gas recirculation, and the pressure in zone 150 increases to balance the control pressure in chamber 162 with the reference pressure.

When the pressure in zone 150 equals the reference pressure, the flow of exhaust gases into zone 150 varies as a function of the exhaust backpressure in passage 116. Since the exhaust backpressure is a function of the flow through engine 110—that is, a function of the exhaust gas flow through passage 116 and thus the induction air flow through passage 112—exhaust gas recirculation through exhaust gas recirculation passage 118 will be proportional to induction air flow through passage 112.

When coil 166 is energized, the regulating valving land 160 applies the pressure from zone 154 to control pressure chamber 162, and EGR control unit 122 positions control valve pintle 128 to provide exhaust gas recirculation at rates which establish the pressure in zone 154 necessary to maintain the control pressure in chamber 162 equal to the reference pressure. Since the entrance to zone 150 is more restricted than the entrance to zone 154, exhaust gas will be recirculated at a lower rate when the pressure in zone 150 equals a reference pressure than when the pressure in zone 154 equals that reference pressure. Thus exhaust gas recirculation will be a higher proportion of induction air flow when regulating valving land 160 directs the pressure from zone 154 to control pressure chamber 162 than when regulating valving land 160 directs the pressure from zone 150 to control pressure chamber 162.

The operating pressure in chamber 134 is at times dependent upon the subatmospheric induction passage pressure signal received from port 172. During closed throttle operation, port 172 senses the substantially atmospheric pressure upstream of throttle 114, and spring 184 engages control valve pintle 128 with valve seat 126 to interrupt exhaust gas recirculation. During wide open throttle operation, the pressure in induction passage 112 downstream of throttle 114 approaches atmospheric pressure, and spring 184 again engages control valve pintle 128 with valve seat 126 to interrupt exhaust gas recirculation. During a range of part throttle operation, however, variations in the induction passage pressure downstream of throttle 114 do not affect exhaust gas recirculation—for if the operating pressure in chamber 134 causes operating diaphragm 132 to move control valve pintle 128 from that position which provides exhaust gas recirculation at the rate establishing the pressures in EGR passage 118 necessary to maintain the control pressure in chamber 162 equal to the reference pressure, transducer 140 will restore the operating pressure in chamber 134 to the level necessary to return control valve pintle 128 to that position.

It will be appreciated that spring 158 is compressed when coil 166 is engergized. The increased bias of spring 158 then reduces the reference pressure on control diaphragm 142 opposing the control pressure in chamber 162. Accordingly, when coil 166 is energized EGR control unit 122 will position control valve pintle 128 to provide exhaust gas recirculation at a rate which establishes a lower pressure in zone 154 than the pressure established in zone 150 when coil 166 is not energized. The increased proportion of exhaust gas recirculation which is provided when coil 166 is energized thus is due both to a lower pressure in the control pressure zone and to a larger orifice between the control pressure zone and the exhaust backpressure in EGR passage 118 upstream of orifice 125.

A screw 186 provides an adjustable stop which is engaged by switching member 160 when coil 166 is not energized. By turning screw 186, the initial force of spring 158 may be adjusted to establish the higher reference pressure.

Fitting 170 is threaded at 188 to adjust the end 190 of air bleed 180 relative to bleed valve 176. This adjustment establishes the distance through which control diaphragm 142 must move bleed valve 176 to obstruct air flow through air bleed 180 and thus establishes the control pressure which must be achieved to overcome the bias of spring 178. Threaded fitting 170 accordingly provides another adjustment for the reference pressure.

In some applications it may be desired to connect transducer port 148 to sense the pressure in zone 154 of EGR passage 118 and to connect transducer port 152 to sense the pressure in zone 150. That structure would permit use of the low reference pressure with small orifice 124 and the high reference pressure with large orifice 125.

The embodiments of the invention in which an exclusive property or privilege is claimed are defined as follows:

1. An exhaust gas recirculation control assembly for an engine having an induction passage for induction air flow and a recirculation passage for exhaust gas recirculation to said induction passage, said assembly comprising a control diaphragm subjected to a reference pressure, a spring exerting a force on said diaphragm contributing to said reference pressure, said diaphragm defining a portion of a control pressure chamber sensing the pressure in a zone in said recirculation passage, a valve for regulating an operating pressure in response to a deviation of the pressure sensed by said chamber from said reference pressure, and a control valve in said recirculation passage for permitting exhaust gas recirculation in accordance with said operating pressure to provide exhaust gas recirculation at rates which maintain the pressure sensed by said chamber equal to said reference pressure, and wherein the improvement comprises a switching member which at one time causes said chamber to sense the pressure in one zone in said recirculation passage and causes said spring to exert one force on said diaphragm and at other times causes said chamber to sense the pressure in another zone in said recirculation passage and causes said spring to exert another force on said diaphragm, whereby exhaust gas recirculation is provided as a proportion of induction air flow with said proportion being higher at said one time than at said other times.

2. An exhaust gas recirculation control assembly for an engine having an induction passage for induction air flow, a recirculation passage for exhaust gas recirculation to said induction passage, means forming two pressure zones in said recirculation passage, a diaphragm defining a portion of an operating pressure chamber, said chamber having an aperture for sensing a subatmospheric pressure signal and also having an air bleed and combining the pressures sensed through said aperture and said air bleed to form an operating pressure, and a control valve in said recirculation passage downstream of said zones and positioned by said diaphragm to permit exhaust gas recirculation in inverse relation to said operating pressure, said assembly comprising a control diaphragm defining a portion of a control pressure chamber, a switching member having one position for connecting said control pressure chamber to one of said pressure zones and a second position for connecting said control pressure chamber to the other of said pressure zones, a spring seated between said control diaphragm and said switching member which in said one position exerts a force contributing to a high reference pressure on said control diaphragm and in said second position exerts another force contributing to a low reference pressure on said control diaphragm, said switching member having means for locating said member in said one position at one time and in said second position at other times, and a bleed valve positioned by said control diaphragm for obstructing flow through said bleed when the pressure sensed by said control pressure chamber exceeds the reference pressure on said control diaphragm, whereby said control valve may be positioned to provide exhaust gas recirculation at rates which at said one time maintain the pressure in said one zone equal to said low reference pressure and at said other times maintain the pressure in said other zone equal to said high reference pressure and thus provide exhaust gas recirculation as a proportion of induction air flow with said proportion being higher at said one time than at said other times.

3. An exhaust gas recirculation control assembly for an engine having an induction passage for induction air flow, a recirculation passage for exhaust gas recirculation to said induction passage, means forming two pressure zones in said recirculation passage, a diaphragm defining a portion of an operating pressure chamber, said chamber having an aperture for sensing a subatmospheric pressure signal and also having an air bleed and combining the pressures sensed through said aperture and said air bleed to form an operating pressure, and a control valve in said recirculation passage downstream of said zones and positioned by said diaphragm to permit exhaust gas recirculation in inverse relation to said operating pressure, said assembly comprising a control diaphragm defining a portion of a control pressure chamber, a switching member having one position for connecting said control pressure chamber to one of said pressure zones and a second position for connecting said control pressure chamber to the other of said pressure zones, a spring seated between said control diaphragm and said switching member which in said one position exerts a force contributing to a high reference pressure on said control diaphragm and in said second position exerts another force contributing to a low reference pressure on said control diaphragm, means for adjusting one of said positions to establish one of said reference pressures, said switching member having means for locating said member in said one position at one time and in said second position at other times, and a bleed valve positioned by said control diaphragm for obstructing flow through said bleed when the pressure sensed by said control pressure chamber exceeds the reference pressure on said control diaphragm, whereby said control valve may be positioned to provide exhaust gas recirculation at rates which at said one time maintain the pressure in said one zone equal to said low reference pressure and at said other times maintain the pressure in said other zone equal to said high reference pressure and thus provide exhaust gas recirculation as a proportion of induction air flow with said proportion being higher at said one time than at said other times.

4. An exhaust gas recirculation control assembly for an engine having an induction passage for induction air flow, a recirculation passage for exhaust gas recirculation to said induction passage, a diaphragm defining a portion of an operating pressure chamber, said chamber having an aperture for sensing a subatmospheric pressure signal and also having an air bleed and combining the pressures sensed through said aperture and said air bleed to form an operating pressure, and a control valve in said recirculation passage downstream of said zones and positioned by said diaphragm to permit exhaust gas recirculation in inverse relation to said operating pressure, said assembly comprising a fitting defining a portion of said air bleed, a control diaphragm defining a portion of a control pressure chamber for sensing the pressure in a zone of said recirculation passage, a spring engaging said control diaphragm and exerting a force contributing to a reference pressure on said diaphragm, and a bleed valve positioned by said control diaphragm for engaging said fitting to obstruct flow through said bleed when the pressure sensed by said control pressure chamber exceeds a reference pressure, whereby said control valve may be positioned to provide exhaust gas recirculation at rates which maintain the pressure sensed by said control pressure chamber equal to said reference pressure to provide exhaust gas recirculation as a proportion of induction air flow, and wherein the position of said fitting may be adjusted with respect to said control diaphragm to establish said reference pressure.

5. An exhaust gas recirculation control assembly for an engine having an induction passage for induction air flow, a recirculation passage for exhaust gas recirculation to said induction passage, means forming two pressure zones in said recirculation passage, a diaphragm defining a portion of an operating pressure chamber, said chamber having an aperture for sensing a subatmospheric pressure signal and also having an air bleed and combining the pressures sensed through said aperture and said air bleed to form an operating pressure, and a control valve in said recirculation passage downstream of said zones and positioned by said diaphragm to permit exhaust gas recirculation in inverse relation to said operating pressure, said assembly comprising a transducer housing, a control diaphragm dividing said housing into an atomospheric pressure chamber and a control pressure chamber, said housing having one port for sensing the pressure in one of said zones and a second port for sensing the pressure in the other of said zones, a switching member having one position opening said one port and obstructing said second port and a second position obstructing said one port and opening said second port, a spring in said atmospheric pressure chamber exerting a force contributing to a reference pressure on said control diaphragm, a spring in said control pressure chamber seated between said control diaphragm and said switching member for biasing said switching member to said one position and which in said one position exerts a force effecting a high reference pressure on said control diaphragm and in said second position exerts a force effecting a low reference pressure on said control diaphragm, said switching member having a portion defining a solenoid armature, a coil energizable for causing said armature to move said member from said one position to said second position against the force of said springs, a fitting extending through said housing into said atmospheric pressure chamber and defining a portion of said air bleed, and a bleed valve positioned by said control diaphragm for engaging in said fitting to obstruct flow through said bleed when the pressure sensed by said control pressure chamber exceeds the reference pressure on said control diaphragm, whereby said control valve may be positioned to provide exhaust gas recirculation at rates which maintain the pressure in said one zone equal to said low reference pressure when said coil is not energized and which maintain the pressure in said other zone equal to said high reference pressure when said coil is energized and thus provide exhaust gas recirculation as a proportion of induction air flow with said proportion being lower when said coil is energized than when said coil is not energized, wherein said assembly further comprises a stop for adjusting said one position of said switching means for establishing said high reference pressure, and wherein the position of said fitting may be adjusted with respect to said control diaphragm to establish said low reference pressure.

* * * * *